US006944420B2

(12) United States Patent
Kanamori et al.

(10) Patent No.: US 6,944,420 B2
(45) Date of Patent: Sep. 13, 2005

(54) IMAGE HEATING APPARATUS WITH FLEXIBLE SLEEVE AND FLANGE MEMBERS IN CONTACT WITH THE SLEEVE

(75) Inventors: Akihito Kanamori, Shizuoka (JP); Satoru Izawa, Shizuoka (JP); Shinji Hashiguchi, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/419,844

(22) Filed: Apr. 22, 2003

(65) Prior Publication Data

US 2003/0206756 A1 Nov. 6, 2003

(30) Foreign Application Priority Data

Apr. 25, 2002 (JP) ..... 2002-124082

(51) Int. Cl.[7] ..... G03G 15/20
(52) U.S. Cl. ..... 399/329; 219/216
(58) Field of Search ..... 399/320, 322, 399/328, 329; 219/216

(56) References Cited

U.S. PATENT DOCUMENTS

| | | | | | |
|---|---|---|---|---|---|
| 4,970,219 | A | | 11/1990 | Effland et al. | 514/339 |
| 5,148,226 | A | | 9/1992 | Setoriyama et al. | |
| 5,149,941 | A | | 9/1992 | Hirabayashi et al. | 219/216 |
| 5,210,579 | A | | 5/1993 | Setoriyama et al. | |
| 5,262,834 | A | * | 11/1993 | Kusaka et al. | 399/329 |
| 5,280,155 | A | * | 1/1994 | Ohtsuka et al. | 219/216 |
| 5,386,281 | A | * | 1/1995 | Mitani et al. | 399/329 |
| 5,450,181 | A | | 9/1995 | Tsukida et al. | |
| 5,722,026 | A | | 2/1998 | Goto et al. | 399/333 |
| 5,752,149 | A | * | 5/1998 | Yuza et al. | 399/329 |
| 5,765,086 | A | * | 6/1998 | Kishino et al. | 399/329 |
| 5,860,051 | A | | 1/1999 | Goto et al. | 399/529 |
| 5,874,710 | A | * | 2/1999 | Yoshimoto et al. | 219/216 |
| 6,430,386 | B2 | * | 8/2002 | Okubo et al. | 399/328 |
| 2002/0168202 | A1 | | 11/2002 | Izawa et al. | 399/329 |
| 2003/0029853 | A1 | | 2/2003 | Izawa et al. | 219/216 |
| 2003/0035667 | A1 | | 2/2003 | Izawa et al. | 399/333 |
| 2003/0038125 | A1 | | 2/2003 | Kataoka et al. | 219/216 |
| 2003/0042241 | A1 | | 3/2003 | Uekawa et al. | 219/216 |

FOREIGN PATENT DOCUMENTS

| | | | | |
|---|---|---|---|---|
| JP | 4-044078 | | 2/1992 | |
| JP | 4-044083 | | 2/1992 | |
| JP | 4-204981 | | 7/1992 | |
| JP | 4-204982 | | 7/1992 | |
| JP | 4-204984 | | 7/1992 | |
| JP | 6-314043 | | 11/1994 | |
| JP | 06337601 | A * | 12/1994 | G03G/15/20 |
| JP | 7-271217 | | 10/1995 | |
| JP | 08234602 | A * | 9/1996 | G03G/15/20 |
| JP | 10284218 | A * | 10/1998 | H05B/3/00 |
| JP | 11030920 | A * | 2/1999 | G03G/15/20 |
| JP | 2001324886 | A * | 11/2001 | G03G/15/20 |

* cited by examiner

*Primary Examiner*—Robert Beatty
(74) *Attorney, Agent, or Firm*—Fitzpatrick, Cella, Harper & Scinto

(57) ABSTRACT

An image heating apparatus has a heating member, a flexible sleeve, a guide member, a flange member, and a pressure member forming a nip part to nip and convey the heating member and the recording material through the sleeve. In this structure, in a recording material movement direction, a sliding-rubbing part of the flange member on a downstream side of the nip part has a shape to project the sleeve toward the downstream side. Alternately, the guide member may have a plurality of ribs on both an upstream side and downstream side of the nip.

7 Claims, 5 Drawing Sheets

IMAGE HEATING APPARATUS WITH FLEXIBLE SLEEVE AND FLANGE MEMBERS IN CONTACT WITH THE SLEEVE

BACKGROUND OF THE INVENTION

1. Field of the Invention

The present invention relates to an image heating apparatus which is suitable if it is applied to a heating fixing apparatus mounted in an image forming apparatus such as an electrophotographic printer, an electrostatic recording printer, a copying machine or the like, and more particularly to the image heating apparatus which uses a flexible sleeve.

2. Related Background Art

Conventionally, many of electrophotographic copying machines, printers and the like adopt a heating roller fixing system of a contact heating type which is excellent in thermal efficiency and safety or a film heating system of an energy saving type, as a heating fixing means.

The heating fixing apparatus which adopts the heating roller fixing system basically consists of a heating roller (called fixing roller hereinafter) acting as a rotation member for heating which contains a halogen heater, and an elastic pressure roller (called pressure roller hereinafter) acting as a rotation member for pressing which is in pressure contact with the fixing roller. Such a pair of the rollers is rotated, a recording material (a transfer material sheet, an electrostatic recording material, an electrofax sheet, a print sheet, or the like) acting as a material to be heated on which an unfixed image (a toner image) has been formed and borne is introduced to a fixing nip part acting as a pressure-contact nip part for the pair of the rollers, and the introduced recording material is thus nipped and conveyed, whereby the toner image is heat-pressed and fixed to the surface of the recording material as a permanent fixed image by heat from the fixing roller and pressure force of the fixing nip part.

On the other hand, as proposed in, e.g., Japanese Patent Application Laid-Open Nos. 63-313182, 2-157878, 4-44075 to 4-44083, 4-204980 to 4-204984, and the like, the heating fixing apparatus which adopts the film heating system closely contacts a heat-resistive film (called fixing film or flexible sleeve hereinafter) acting as a rotation member for heating with a heating member (called heating body hereinafter) such as a fixedly disposed ceramic heater or the like by a rotation pressure member (called pressure roller or pressure member hereinafter), thereby slidingly rotating the fixing film. Then, a recording material on which a toner image has been formed and borne is introduced to a fixing nip part acting as a pressure-contact nip part which is structured so that the fixing film is placed between the heating body and the pressure roller, and the introduced recording material is conveyed together with the fixing film, whereby the toner image is heat-pressed and fixed to the surface of the recording material as a permanent fixed image by heat applied from the heating body through the fixing film and pressure force of the fixing nip part.

The heating fixing apparatus which adopts the film heating system can use, as the heating body, a small thermal-capacity linear heating body such as the ceramic heater or the like, and also use a small thermal-capacity thin film as the fixing film, whereby it is possible to save power and shorten a waiting time (i.e., achieve quick start). Incidentally, a method of providing a drive roller on the interior surface of the fixing film and a method of using the pressure roller as a drive roller and thus driving the fixing film by the frictional force between the drive roller and the pressure roller are known as a fixing film driving system to be used in the heating fixing apparatus which adopts the film heating system. In recent years, pressure roller driving system is frequently used because the number of parts is low and the cost is low.

FIG. 9 is a view schematically showing the structural model of one example of the heating fixing apparatus which adopts the pressure roller driving system and the film heating system.

In FIG. 9, numeral 30 denotes a heating assembly and numeral 32 denotes an elastic pressure roller which acts as the pressure member. The heating assembly 30 and the elastic pressure roller 32 which are disposed in parallel above and below are pressure-contacted with each other to form a fixing nip part N.

The heating assembly 30 is the assembly which consists of a heater 33 acting as the heating member (heating body), a film guide 35 acting as the guide member supporting the heater 33, a cylindrical fixing film 31 containing the film guide 35 and acting as the flexible rotation body internally contacted with the heater 33, a flange member 36 supporting the fixing film 31 by its both ends and fit to the film guide 35, and the like.

The heater 33 is the oblong and thin ceramic heater of which the longitudinal length expands along the direction perpendicular to the conveying direction of a recording material P and the heat capacity is entirely small, and the heater 33 receives power supply and thus generates heat.

The film guide 35 is the gutterlike oblong member of which the cross section is substantially a semicircular arc and the longitudinal side extends in the direction perpendicular to the conveying direction of the recording material P, and, for example, the film guide 35 is made of phenolic thermosetting resin. The heater 33 is fit into a heater fit groove which is formed longitudinally on the approximately central part on the under surface of the film guide 35 and thus fixedly supported.

The cylindrical fixing film 31 is loosely fit outwardly to the film guide 35 into which the heater 33 has been fit.

The flange member 36 includes a collar washer part **36*a* which catches the end part of the cylindrical fixing film 31 and regulates the movement of the fixing film toward its axis line direction, and a fixing film sliding part 36*b* which is substantially a circular arc and is fit to the inside of the end of the cylindrical fixing film 31 to support the fixing film end. The flange member 36 is fit to both ends of the film guide 35** and thus settled.

The elastic pressure roller 32 is rotatably bearing-supported between the side covers (not shown) of the heating fixing apparatus, the heating assembly 30 is disposed in parallel above the elastic pressure roller 32 with the heater 33 side downward, the heating assembly 30 and the elastic pressure roller 32 are pressed into each other by a not-shown pressure means against the elasticity of the pressure roller 32, and the heater 33 and the pressure roller 32 are thus pressure-contacted with each other so that the fixing film 31 is placed between the heater 33 and the pressure roller 32, whereby the fixing nip part N which acts as the pressure-contact nip part of a predetermined width is formed due to the elastic deformation of the pressure roller 32.

The elastic pressure roller 32 is rotatively driven counterclockwise as indicated by the arrow by a not-shown driving means. By rotatively driving the pressure roller 32, rotative force is applied to the fixing film 31 in the fixing nip part N due to the frictional force between the pressure roller 32 and the exterior surface of the fixing film 31. Then, the interior surface of the fixing film 31 is rotated clockwise as indicated by the arrow around the periphery of the film guide 35 at a periphery speed substantially corresponding to that of the pressure roller 32 as the interior surface of the fixing film 31 is in close contact with and slides along the lower surface of the heater 33 in the fixing nip part N (pressure roller driving system).

The movement of the rotating fixing film 31 in its axis line direction (longitudinal direction) is regulated by the collar washer part 36*a* of the flange member 36, and the inside of the end of the fixing film 31 is supported and rotatively guided by the fixing film sliding part 36*b* of the flange member 36.

Then, in a state that the fixing film 31 is rotatively driven by the pressure roller 32 and the temperature thereof has reached a predetermined temperature due to electrification to the heater 33, when the recording material P on which an unfixed toner image T has been formed and borne is introduced from a not-shown image forming part to the position between the fixing film 31 and the pressure roller 32 in the fixing nip part N, the recording material P passes the fixing nip part N together with the fixing film 31 in the state that the recording material P overlaps and is in close contact with the exterior surface of the fixing film 31.

While the recording material P is passing the fixing nip part N, the thermal (or heat) energy of the heater 33 is applied to the recording material P through the fixing film 31, whereby the unfixed toner image T on the recording material P is subjected to a heating melt fixing process. After then, the recording material P which passed the fixing nip part N is separated from the surface of the fixing film 31 at a separation point A and then discharged.

In regard to the image forming apparatus such as the electrophotographic printer or the like which uses the above heating fixing apparatus of the film heating system, increase in print speed is demanded according to improvement of image quality in recent years. Even if a passing time of the recording material in the fixing nip part N is shortened due to the increase in print speed, it is necessary to lower a melting point of the toner as well as improvements such as increase in fixing temperature, enlargement of the fixing nip part N, and increase in heat conduction of the materials of the heater substrate and the fixing film in order to maintain the fixability of the toner image T to the recording material P equivalent to the conventional level.

From the viewpoint of maintaining the fixability corresponding to high-speed print, a significant effect can be achieved by the combination of the increase in thermal energy supply amount to the recording material P per unit time due to the increase in fixing temperature, the enlargement of the fixing nip part and the like and the lowering of the melting point due to increase in, e.g., low molecular weight component of the toner. However, if the fixing temperature (i.e., a target temperature of the heater) is set to be high, also the temperature of the film guide 35 becomes high, and the heat of the film guide 35 is conducted to the fixing film 31 too. As a result, the toner temperature on the fixing film 31 and the recording material P at the separation point A thus becomes high. Therefore, cohesion of the toner T on the fixing film 31 and the recording material P at the separation point A becomes lower than adhesion between the toner T and the fixing film 31, whereby it becomes easy to cause a so-called hot offset T' that the toner remains on the surface of the fixing film 31 after the film was separated from the recording material P.

SUMMARY OF THE INVENTION

The present invention has been completed in consideration of such a problem as above, and an object thereof is to provide an image heating apparatus which can suppress an offset of image.

Another object of the present invention is to provide an image heating apparatus comprising:

a heating member;

a flexible sleeve rotating around the heating member;

a guide member, provided inside the sleeve, for guiding movement of the sleeve;

flange members, provided at both the ends of the guide member in its longitudinal direction, each having a part sliding and rubbing with an interior periphery surface of the end of the sleeve; and a pressure member forming a nip part to nip and convey the heating member and a recording material through the sleeve, wherein, in a recording material movement direction, the sliding-rubbing part of the flange member on the downstream side of the nip part has a shape to project the sleeve toward the downstream side.

Still another object of the present invention is to provide an image heating apparatus comprising:

a heating member;

a flexible sleeve rotating around the heating member;

a guide member, provided inside the sleeve, for guiding movement of the sleeve;

a pressure member forming a nip part to nip and convey the heating member and a recording material through the sleeve, wherein, in a recording material movement direction, the guide member has a plurality of ribs on both the upstream side and the downstream side of the nip part, the number of ribs on the downstream side is smaller than the number of ribs on the upstream side, and the rib on the downstream side is larger than the rib on the upstream side.

Further object of the present invention will become apparent by reading the following detailed explanation as referring to the attached drawings.

DETAILED DESCRIPTION OF THE PREFERRED EMBODIMENTS

<Embodiment 1>

(1) Example of Image Forming Apparatus

Figure 1:
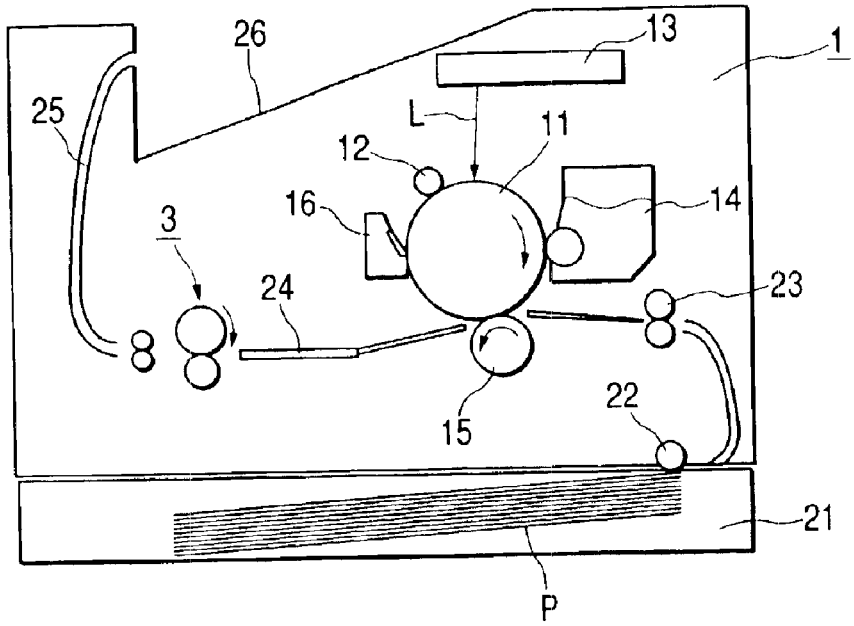
FIG. 1 is a view schematically showing the structural model of an image forming apparatus according to the embodiment 1.

FIG. 1 is a view schematically showing the structural model of one example of the image forming apparatus which is equipped with, as a heating fixing apparatus 3, an image heating apparatus according to the present invention. An image forming apparatus 1 in the present embodiment is a laser beam printer which uses an electrophotographic process.

Numeral 11 denotes a photosensitive drum which acts as an image bearing body, and is structured by forming a photosensitive material such as OPC, amorphous silicon or the like on a cylindrical base substance such as aluminum, nickel or the like. The photosensitive drum 11 is rotatively driven clockwise as indicated by the arrow at a predetermined periphery speed.

While the photosensitive drum 11 is being rotated, the surface thereof is uniformly charged to predetermined polarity and potential by a charging roller 12 acting as a charging apparatus. Then, the surface of the photosensitive drum 11 is scan-exposed by a laser beam L which is output by a laser scanner 13 acting as an exposure means and ON/OFF controlled in response to image information, whereby an electrostatic latent image corresponding to the scan-exposed image information is formed on the photosensitive drum 11. The formed electrostatic latent image is then developed and thus visualized as a toner image by a developing apparatus 14. Here, a jumping developing method, a two-component developing method or the like is used as a developing method, and, in the developing method, a combination of image exposure and reversal developing is often used. In the printer according to the present embodiment, the surface of the photosensitive drum 11 is uniformly charged to a predetermined minus potential, the image exposure is performed on the charged surface by the laser scanner 13 to form the electrostatic latent image, and the reversal developing is performed to the formed electrostatic latent image by the developing apparatus 14.

On one hand, a recording material P of one sheet is separated and fed from a cassette 21 and conveyed to a registration roller 23 by a feed roller 22. The recording material P is then fed to a transfer nip part which consists of the photosensitive drum 11 and a transfer roller 15 by the registration roller 23, in synchronism with the toner image formed on the surface of the photosensitive drum 11. In the transfer nip part, the toner image on the photosensitive drum 11 is transferred to the recording material P by the action of a transfer bias applied from a not-shown power supply to the transfer roller 15.

The recording material P which passed the transfer nip part is separated from the surface of the photosensitive drum 11, the recording material P which bears the toner image is then conveyed to the heating fixing apparatus 3 through a sheet path 24, the conveyed recording material P is heated and pressed in the nip part of the heating fixing apparatus 3, whereby the toner image is fixed on the recording material P as a permanent image. Then, the recording material P is discharged onto an external discharge tray 26 through a sheet path 25.

On one hand, the transfer residual toner which remains on the photosensitive drum 11 after the toner image was transferred to the recording material P is eliminated from the surface of the photosensitive drum 11 by a cleaning apparatus 16, whereby the photosensitive drum 11 is repetitively used for image formation.

(2) Heating Fixing Apparatus 3

Figure 2:
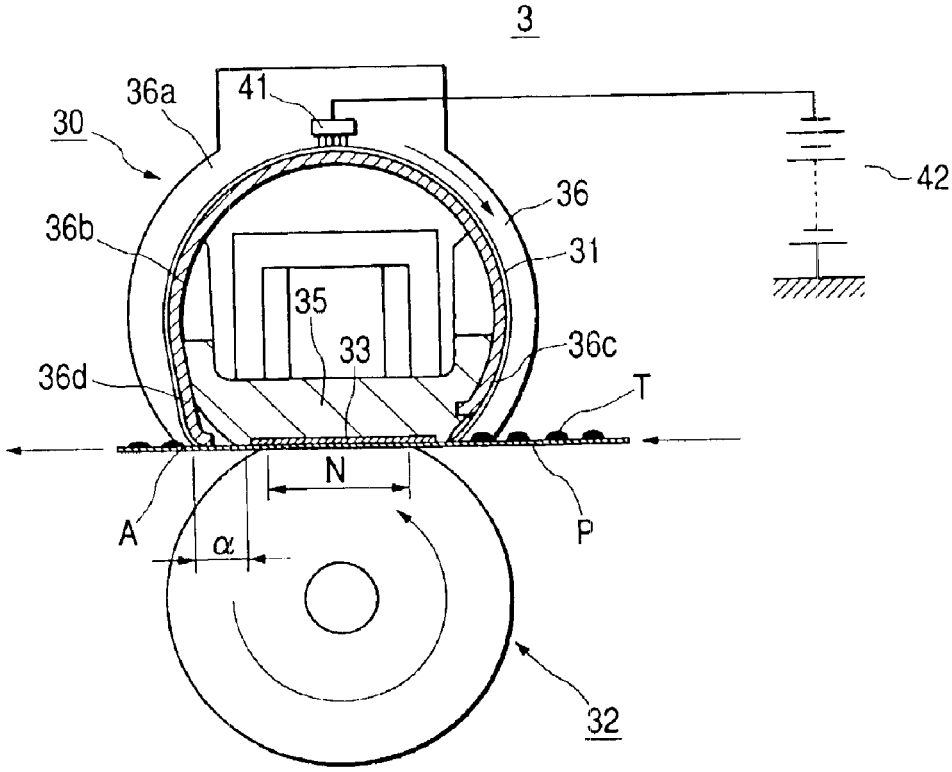
FIG. 2 is a view showing the cross-sectional model of the main part of a heating fixing apparatus.

FIG. 2 is a view showing the cross-sectional model of the main part of the heating fixing apparatus 3 according to the present embodiment. As well as the above-described conventional heating fixing apparatus shown in FIG. 9, the heating fixing apparatus 3 according to the present embodiment is the heating fixing apparatus of pressure roller driving system and film heating system which uses a cylindrical fixing film (flexible sleeve). Here, it should be noted that the structural members and parts common to those of the heating fixing apparatus shown in FIG. 9 respectively have the numerals and symbols common to those shown in FIG. 9, and the repetitive explanations of these members and parts will be omitted.

Figure 3:
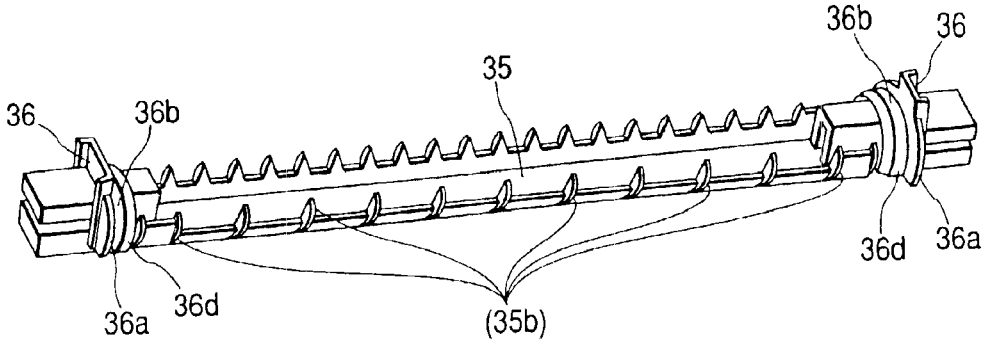
FIG. 3 is an outer perspective view showing a film guide and flange members which are fit to the both ends of the film guide.
Figure 4A:
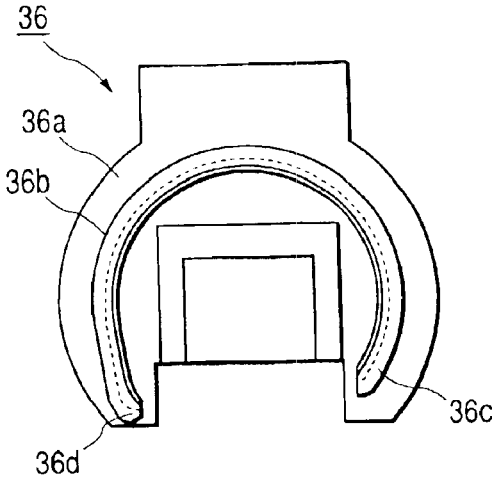
FIG. 4A is a plan view showing the interior surface side of the flange member.
Figure 4B:
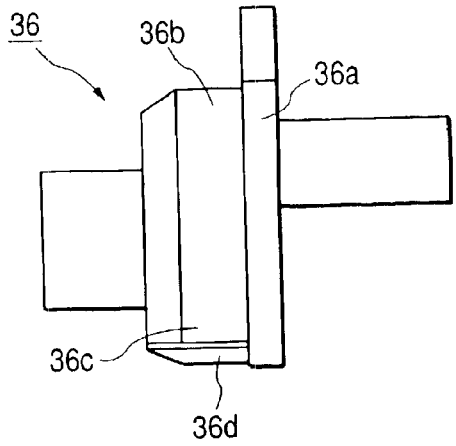
FIG. 4B is a side view showing the interior surface side of the flange member.
Figure 5A:
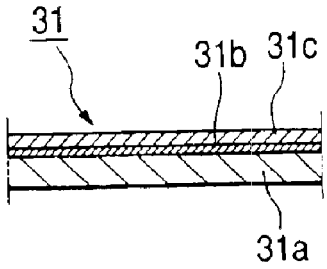
FIG. 5A is a view showing the layer structure model of a fixing film.
Figure 5B:
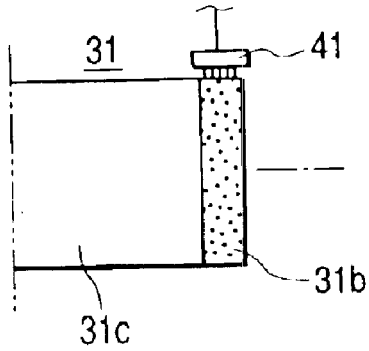
FIG. 5B is a view showing the model of a primer layer exposure part.

FIG. 3 is an outer perspective view showing a film guide 35 and flange members 36 which are fit to the both ends of the film guide 35, FIG. 4A is a plan view showing the interior surface side of the flange member 36, FIG. 4B is a side view showing the interior surface side of the flange member 36, and FIGS. 5A and 5B are views showing the layer structure model of a fixing film 31.

(i) Heater 33

The heater 33 which acts as the heating member is composed in such a manner of sequentially forming a heat generation body in which a heat generation paste has been printed on a ceramic substrate and a glass coating layer which protects the heat generation body and secures insulation performance. The heater 33 generates heat by flowing a power-controlled AC current to the heat generation body on the heater 33. Here, aluminum nitride, aluminum oxide or the like is used as the material of the ceramic substrate. A thermistor for temperature adjusting (not shown) is abutted on the back side of the ceramic substrate, whereby the electrification to the heat generation body is controlled so that the temperature detected by the thermistor maintains a target temperature.

(ii) Film Guide 35

The film guide 35 which acts as the guide member supports the heater 33. Each of the upstream-side and downstream-side cross-sectional shapes of the heater 33 in the recording material conveying direction is a semicircle arc.

(iii) Fixing Film 31

The endless-belt heat-resistive film (fixing film) 31 which is flexible contains the film guide 35 so that there is room in the length of the periphery of the film guide 35 (i.e., in the state that any tension is not applied). Both the ends of the fixing film 31 are slidably and rotatably supported by the flange 36 fitting to both the longitudinal-direction ends of the film guide 35.

As shown in FIG. 5A illustrating the layer structure model, the fixing film 31 is the multilayer film that a mold release layer 31*c* obtained by mixing a conductive member such as carbon black or the like into PTFE, PFA, EFP or the like through a conductive primer layer 31*b* is coated on the surface of a small thermal-capacity heat-resistive resin film (base film) 31*a* such as polyimide, polyamide-imide, PEEK, PES or the like. The mold release layer 31*c* has been designed to have an optimum resistance, so as not to cause various defective images. Besides, the fixing film 31 is grounded to prevent a charge-up damage. Moreover, as shown in FIG. 5B, in order to cause to apply a later-described fixing bias, the conductive primer layer 31*b* is exposed partially on the surface of the fixing film and the exposed part is contacted with a power supply means 41 such as a conductive brush or the like.

The fixing film 31 may be a metal sleeve that the above mold release layer is coated on the surface of a thin metal crude tube such as a stainless steel tube or the like through a primer layer. In this case, the metal crude tube is exposed partially on the surface of the metal sleeve for the grounding of the fixing film and the bias application.

(iv) Flange Member 36

A fixing film sliding part 36*b* of the flange member 36 is a circular arc of which the radius is substantially the same as that of the fixing film 31. The flange member 36 which is attached to each of both the longitudinal-direction ends of the guide member 35 includes a collar washer part 36*a* for regulating the movement of the fixing film toward its bus line direction and the fixing film sliding part 36*b* sliding along the interior surface of the longitudinal-direction end of the cylindrical fixing film 31.

(v) Pressure Roller 32

The pressure roller 32 which acts as the pressure member is the rotation body which is composed by an elastic layer of heat-resistive rubber such as silicon rubber or the like disposed on a core metal, or an insulative mold release layer made of fluoroplastic such as PFA, PTFE, FEP or the like disposed on the core metal through a foamed sponge elastic layer. The elastic layer has been made conductive by mixing therein a conductive member such as carbon black or the like to prevent a charge-up damage on the surface of the insulative mold release layer, whereby it is preferable to ground the core metal.

Both the ends of the pressure roller 32 are pressure-contacted with a heating assembly 30 by not-shown springs, and the pressure roller 32 is rotatively driven by a not-shown drive system, whereby a recording material P and the fixing film 31 are together rotated according to the rotation of the pressure roller 32 and thus conveyed. The recording material P which bears an unfixed toner image T is heated and pressed in a pressure-contact nip (fixing nip) part N which is formed between the heating assembly 30 and the pressure roller 32 of the heating fixing apparatus 3, the toner image T is thus fixed to the recording material P, and the recording material P is thereafter discharged outwardly from the image forming apparatus 1.

(vi) Lubricant

The lubricant is put between the lower surface of the heater 33 in the fixing nip part N, i.e., a glass coating layer of the heater 33, and the back surface (interior periphery surface) of the fixing film 31, i.e., the surface opposite to the side being in contact with the toner image T of the recording material P, thereby stabilizing sliding torque between the fixing film 31 and the heater 33 in the fixing nip part N low and thus preventing a slip between the fixing film 31 and the recording material P. Here, it should be noted that heat-resistive fluoric grease (e.g., HP-300 GREASE available from Dow Corning Ltd., or DEMNUM GREASE L-65 available from DAIKIN INDUSTRIES, LTD.) or the like is used as the lubricant.

(vii) Fixing Bias Applying Means

A power supply means 41 such as a conductive brush or the like is contacted with the conductive primer layer 31*b* (FIGS. 5A and 5B) partially exposed on the surface of the fixing film 31, whereby the fixing bias of which the polarity is the same as that of the toner T is applied from a bias power supply 42 (FIG. 2) to the fixing film 31. Here, the application of the fixing bias is performed at least while the recording material P is in contact with the fixing film 31.

(3) Suppression of Hot Offset

The rotation locus of the fixing film 31 in the vicinity of the fixing nip part N is as follows. That is, on the upstream side of the fixing nip part N in the recording material conveying direction, the rotation locus is a circular arc or has the shape similar to the circular arc so that the fixing film 31 is in contact with ribs 35*b* on the upstream side of the film guide 35. On the downstream side of the fixing nip part N in the recording material conveying direction, the fixing film 31 is regulated to project toward the downstream direction, whereby the fixing film 31 is not approximately in contact with the ribs 35*b* on the downstream side of the film guide 35. In order to cause the fixing film to represent the rotation locus like this, as shown in FIG. 2 or FIGS. 4A and 4B (the flange member 36 shown in FIGS. 4A and 4B is the left one shown in FIG. 3), the shape of the fixing film sliding part 36*b* of the flange member 36 in the vicinity of the fixing nip part on the upstream side in the recording material conveying direction is set to substantially a circular arc 36*c* as well as the film guide 35. Conversely, on the downstream side in the recording material conveying direction of the fixing film sliding part 36*b* in the vicinity of the fixing nip part, a projection 36*d* to project the fixing film 31 toward the downstream direction in the vicinity of the part to be fit to the film guide 35 is provided. That is, the fixing film sliding part 36*d* of the flange member 36 on the downstream side of the fixing nip part is longer than the upstream-side fixing film sliding part 36*c* toward the pressure member side.

The purpose of such a structure is to alienate a separation point A of the fixing film 31 and the recording material P in the vicinity of the fixing nip part on the downstream side in the recording material conveying direction from the fixing nip part N and the film guide 35 supporting the heater 33 by a distance $\alpha$ shown in FIG. 2, and further to project only both the longitudinal-direction ends of the fixing film 31 toward the downstream side in the recording material conveying direction by the flange members 36, so that the fixing film 31 is made difficult to come into contact with the film guide 35 on the downstream side of the fixing nip part, thereby decreasing a thermal (or heat) transfer amount from the large thermal-capacity film guide 35 supporting the heater 33 acting as the heat source to the fixing film 31.

Thus, since the fixing film is not heated by the heater and the film guide while the fixing film is being moved by the distance $\alpha$, the temperature of the fixing film during the distance $\alpha$ is low as compared with the case where the fixing film is in contact with the film guide. Therefore, the toner T heated and molten in the fixing nip part N can be cooled by the time when the recording material P reaches the separation point A, whereby it is possible to lower the temperature of the toner T at the separation point A. Consequently, cohesion of the toner T at the time when the fixing film 31 is separated from the recording material P can be made higher than adhesion between the toner T and the fixing film 31, whereby it is possible to suppress the residual of the toner T, i.e., the hot offset, on the fixing film 31 after the film was separated from the recording material P.

Meanwhile, on the upstream side of the fixing nip part, the fixing film 31 is rotated according to the rotation of the pressure roller 32, whereby the fixing film 31 is always pulled toward the fixing nip part side. Thus, for the purpose of smooth rotation of the fixing film 31, the part of the fixing film on the upstream side of the fixing nip part is in contact with the ribs 35*b* of the film guide 35.

Moreover, in order to further suppress the hot offset, it is preferable to suppress the toner residing on the fixing film 31 by applying the fixing bias of which the polarity is the same as that of the toner T from the bias applying means 41 and 42 to the fixing film 31 and thus electrostatically pressing the toner T into the recording material P, at least while the recording material P is in contact with the fixing film 31. A synergistic effect concerning this electrostatic suppression of the hot offset due to the bias application can be achieved since the cohesion of the toner T at the interface between the fixing film 31 and the recording material P improves because of the lowering of the temperature of the toner T at the separation point A of the fixing film 31 and the recording material P according to the present embodiment.

Incidentally, in the present embodiment, the fixing film and the film guide are not substantially or completely in contact with each other on the downstream side of the fixing nip part, the ribs 35*b* of the film guide 35 need not be provided on the downstream side of the fixing nip part. On one hand, in case of providing the ribs 35*b* on the downstream side, it is preferable to make the number of ribs smaller than the number of ribs on the upstream side.

(4) Comparative Experiment with Conventional Example

Figure 9:
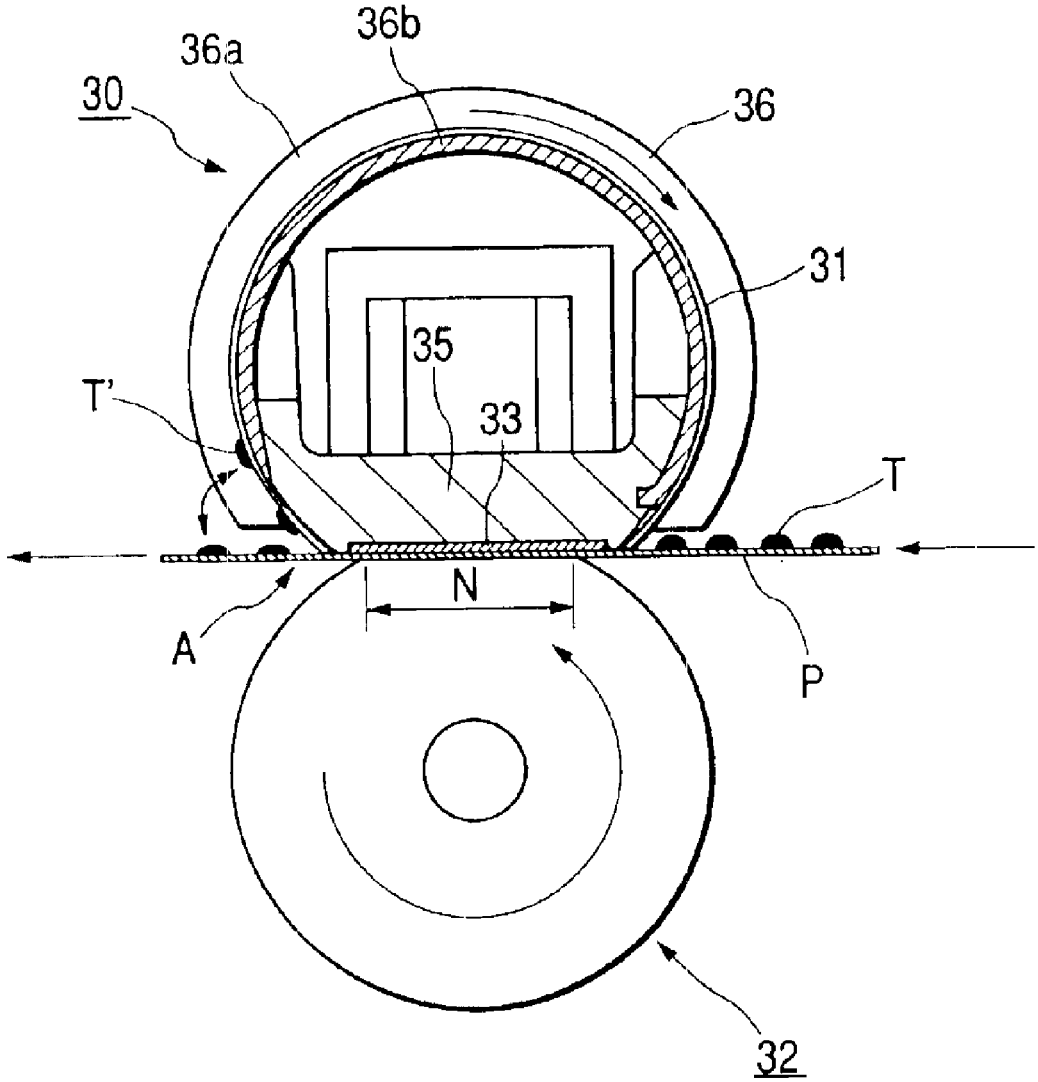
FIG. 9 is a view showing the cross-sectional model of the main part of a conventional heating fixing apparatus.

The case where the above heating fixing apparatus 3 according to the present embodiment is used is compared with the case where the rotation loci of the fixing film 31 in the vicinity of the fixing nip part on both the upstream side and the downstream side are set to substantially the circular arc as well as the film guide 35 as in the conventional heating fixing apparatus (FIG. 9). Incidentally, hot offset evaluations based on presence/absence of the fixing bias are performed at different print speeds (20, 30 and 40 PPM) in the respective cases, and the results thereof are shown in Table 1 below. In the table, it should be noted that symbol ○ indicates an OK level, symbol Δ indicates a level without problem on practical use, and symbol × indicates an NG level.

Besides, a pattern of which the leading end 100 mm represents characters and the trailing end represents solid white is printed on a plain paper which has been left for 24 hours or more under an environment of 23° C./60%RH, and then an offset state of a character pattern on the solid white part of the paper is observed and evaluated.

TABLE 1

| | fixing bias | hot offset level | | |
|---|---|---|---|---|
| | | 20 PPM | 30 PPM | 40 PPM |
| present embodiment | not present | ○ | ○ | Δ |
| | present | ○ | ○ | ○ |
| conventional example | not present | Δ | x | x |
| | present | ○ | Δ | x |

It is necessary to set the fixing target temperature higher to maintain fixation of the toner as the print speed increases. Thus, although in the conventional example the temperature of the toner T at the separation point A of the fixing film 31 and the recording material P increases as the apparatus of higher print speed is used, a hot offset margin in the present embodiment is wide as compared with the conventional example irrespective of presence/absence of the fixing bias, whereby it is possible to confirm that the hot offset is suppressed even if the operation speed of the heating fixing apparatus increases and also the fixing target temperature increases.

That is, the rotation locus of the fixing film 31 in the vicinity of the fixing nip part on the downstream side in the recording material conveying direction is regulated to partially project toward the downstream direction so that the fixing film is not in contact with the film guide on the downstream side of the fixing nip part. Thus, the temperature of the toner T when the fixing film 31 is separated from the recording material P decreases, and the cohesion of the toner T thus increases, whereby the hot offset can be suppressed.

(5) Comparative Experiment in Case of Different Fixing Bias Applying System

Next, a case where a different fixing bias applying system (FIG. 6) is adopted will be described. Here, it should be noted that this fixing bias applying system is adopted in a case where it is necessary to suppress a backward toner scatter phenomenon due to increase in print speed.

(i) Charge Elimination Means

A charge elimination 43 such as a grounded conductive roller or the like is provided at the position which is in contact with the back surface of the printed surface of the recording material P which passed the fixing nip part N. The charge elimination means 43 may have any conformation such as a brush, a guide or the like, if it has conductivity.

(ii) Application of Fixing Bias

A minus (negative) bias of which the polarity is the same as that of the toner T (here, toner of minus polarity is used) is applied from the fixing bias applying means 41 and 42 to the fixing film 31 by a predetermined amount, at least while the recording material P is in contact with the fixing film 31. Thus, a plus (positive) electrical charge of which the polarity is opposite to the minus bias applied from the grounded part of the charge elimination means 43 through the resistance of the recording material P is induced on the back surface of the printed surface of the recording material P, and the opposite-polarity toner T is attracted and fixed to the recording material P by the induced plus electrical charge.

In the fixing bias applying system as described above, comparative evaluations of the hot offset and the backward toner scatter phenomenon according to the magnitude of the fixing bias applying amount at a print speed of 40 PPM are performed in regard to the case where the rotation locus of the fixing film 31 explained in the present embodiment is adopted and the case where the rotation locus in the above conventional example (FIG. 9) is adopted, and the results thereof are shown in Table 2 below. In the table, it should be noted that symbol ○ indicates an OK level, symbol Δ indicates a level without problem on practical use, and symbol × indicates an NG level.

Besides, in regard to the hot offset, a pattern of which the leading end 100 mm represents characters and the trailing end represents solid white is printed on a plain paper which has been left for 24 hours or more under an environment of 23° C./60%RH, and then an offset state of a character pattern on the solid white part of the paper is observed and evaluated. Further, in regard to the backward toner scatter phenomenon, a pattern on which lines are arranged in the direction perpendicular to the paper conveying direction is printed on a plain paper which has been left for 24 hours or more under an environment of 23° C./60%RH, and then a state that the toner is scattered backward is observed and evaluated.

TABLE 2

| bias applying amount | | −100 V | −300 V | −700 V |
|---|---|---|---|---|
| hot offset | present embodiment | ○ | ○ | ○ |
| | conventional example | ○ | Δ | x |
| backward toner scatter | present embodiment | x | Δ | ○ |
| | conventional example | x | Δ | ○ |

As the result of this, as compared with the conventional example, it is possible in the present embodiment to confirm that any problem concerning the hot offset does not occur even if the fixing bias increases. Furthermore, it is possible to confirm that, even in the case where it is necessary to apply the high fixing bias for suppressing the backward toner scatter phenomenon caused due to increase in print speed, the heating fixing apparatus can suppress both the hot offset and the backward toner scatter phenomenon and moreover increase the operation speed.

Here, the difference between the hot offset condition in the present embodiment and the hot offset condition in the conventional example, due to increase in the fixing bias, will be explained.

In the fixing bias system, a plus (positive) current is flowed in the recording material P so as to induce the plus electrical charge of which the polarity is opposite to that of the toner on the back surface of the printed surface of the recording material P, and this current flows from the recording material P toward the fixing film 31 side in the vicinity of the separation point A of the fixing film 31 and the recording material P. For this reason, the toner of which the minus electrical charge is light is inversed because of this plus current in the vicinity of the separation point A and is thus in the state which easily adheres to the fixing film 31 side to which the minus bias has been applied.

In such a state, in the case of the conventional example where the toner temperature when the fixing film 31 is separated from the recording material P is high and thus the toner cohesion is light, the polarity-inverted toner is adhered to the fixing film 31, and the adhesion amount further increases due to increase in the fixing bias.

On the other hand, as in the present embodiment, in the case were the toner temperature when the fixing film 31 is separated from the recording material P is low and thus the toner cohesion is high, even if the partial toner is inverted, the adhesion of the toner to the fixing film 31 can be suppressed because the cohesion of the mutual toner is strong.

<Embodiment 2>

Figure 7:
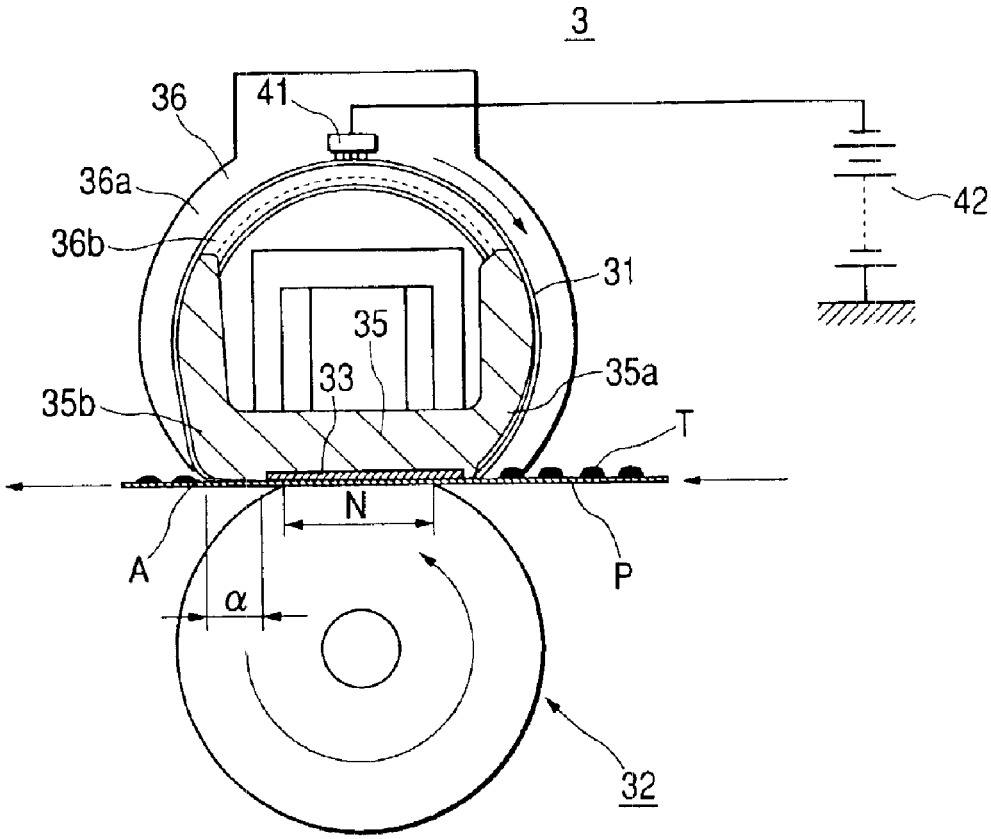
FIG. 7 is a view showing the cross-sectional model of the main part of a heating fixing apparatus according to the embodiment 2.

As the embodiment 2, another example of regulating method for the rotation locus in the vicinity of the fixing nip part of a fixing film 31 is shown in FIG. 7. Here, it should be noted that the parts respectively having the same functions as those in the embodiment 1 respectively have the same numerals and symbols as those in the embodiment 1, and the repetitive explanations of these parts will be quoted.

(1) Regulation of Rotation Locus by Film Guide 35

Figure 8:
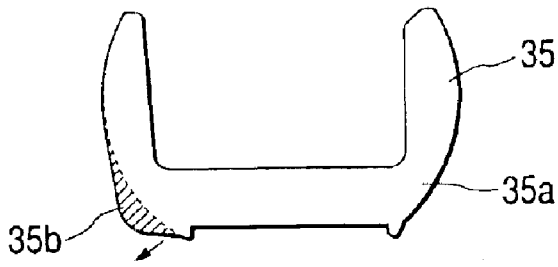
FIG. 8 is a view for explaining the shape of the film guide.

In the present embodiment, the rotation locus of the fixing film in the vicinity of the fixing nip part is set to substantially the radius of the fixing film 31 on the upstream side of a fixing nip part N in the recording material conveying direction. Since the rotation locus of the fixing film on the downstream side of the fixing nip part N in the recording material conveying direction is regulated so as to partially project the downstream direction, as shown in FIG. 8, the shape of the fixing film sliding part of the film guide 35 in the vicinity of the fixing nip part is set to a shape 35*a* which is substantially the radius of the fixing film 31 on the upstream side of the fixing nip part in the recording material conveying direction, whereas a comb-teeth projection (rib) 35*b* (FIG. 8 and FIG. 3) in the vicinity of the fixing nip part to project the fixing film 31 toward the downstream side is provided on the downstream side of the fixing nip part in the recording material conveying direction. Besides, the number of ribs 35*b* on the downstream side of the fixing nip part is set to be smaller than the number of ribs 35*b* on the upstream side.

Therefore, it is possible to alienate a separation point A of the fixing film 31 and a recording material P on the downstream side of the fixing nip part from the fixing nip part N and the frame of the film guide 35 supporting a heater 33 by a distance α shown in FIG. 7. Thus, although the fixing film is in contact with the film guide on the downstream side of the fixing nip part, it is possible to decrease a thermal transfer amount from the film guide to the fixing film because the number of ribs on the downstream side is smaller than the number of ribs on the upstream side, and it is further possible to lower the temperature of toner T at the time when the fixing film 31 is separated from the recording material P, whereby, as well as the embodiment 1, it is possible to suppress a hot offset. At this time, in order to decrease the thermal transfer from the large thermal-capacity film guide 35 supporting the heater 33 acting as the heat source to the fixing film 31 at the separation point A as much as possible, it is preferable to partially provide the comb-teeth projections 35*b* in the longitudinal direction of the film guide 35 as shown in FIG. 3.

Moreover, it is possible to stabilize the rotation locus of the fixing film 31 on the downstream side of the fixing nip part by changing the system of regulating only both the ends of the fixing film 31 by the flange members 36 as in the embodiment 1 to the system of regulating the entire longitudinal edge of the fixing film 31 by the film guide 35. Therefore, even if the thin recording material P of which the firmness has been broken due to long-term leaving under high-temperature and high-humidity environments is used, it is possible to suppress a harmful effect, such as slack (e.g., paper wrinkle or the like) of the fixing film 31 on the downstream side of the fixing nip part, which is caused by unstableness of the rotation locus.

The shape of a fixing film sliding part 36*b* of a flange member 36 at this time may be set to substantially a circular arc (36*c* of FIG. 4A) on both the upstream side and the downstream side of the fixing nip part. However, in order to stabilize the rotation locus of the fixing film 31, it is preferable as well as the embodiment 1 to provide, on the downstream side of the fixing nip part, the projection 36*d* to project the fixing film 31 toward the downstream direction. Moreover, in order to regulate the rotation locus of the fixing film 31 by the film guide 35, it is preferable to set the height of the projection 36*d* of the flange member 36 to be somewhat lower than the height of the comb-teeth projections 35*b* of the film guide 35.

Of course, in order to further suppress the hot offset, it is possible as well as the embodiment 1 to apply the fixing bias of which the polarity is the same as that of the toner T to the fixing film 31 at least while the recording material P is in contact with the fixing film 31.

Figure 6:
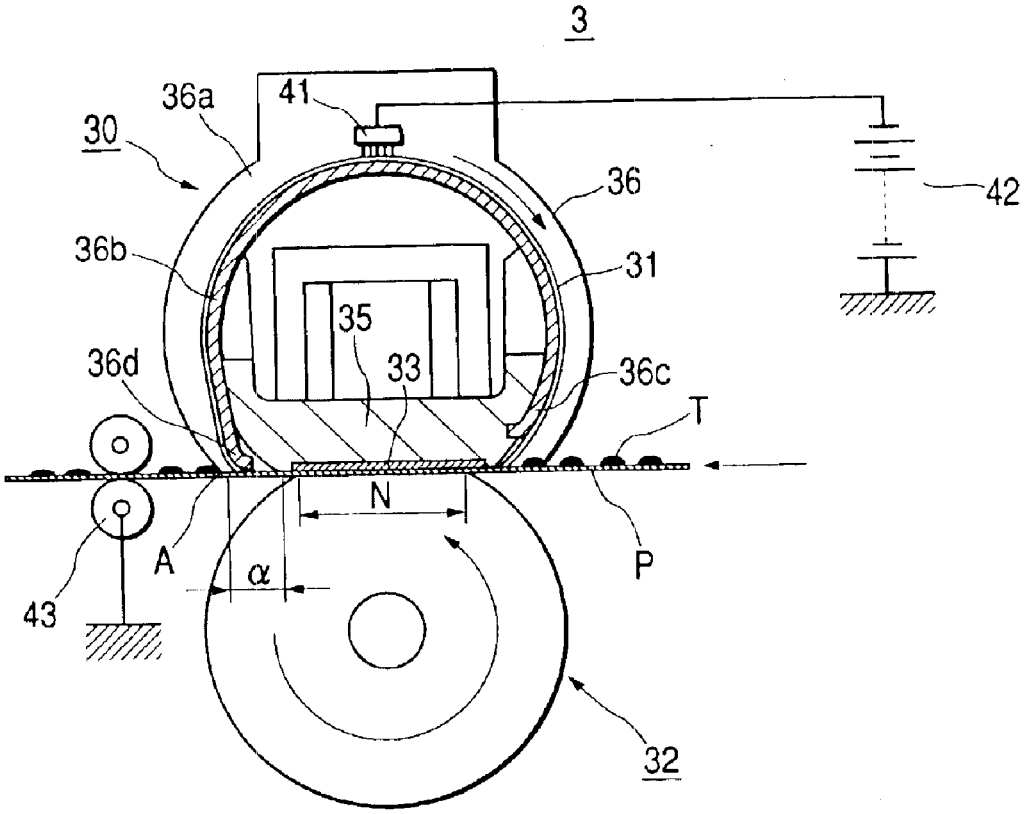
FIG. 6 is a view for explaining other example of a fixing bias applying system.

Moreover, in order to suppress the backward toner scatter phenomenon, it is possible as well as the embodiment 1 shown in FIG. 6 to adopt such a fixing bias structure as inducing the plus electrical charge of which the polarity is opposite to that of the toner on the back surface of the printed surface of the recording material.

(2) Comparative Experiment

Hot offset evaluations based on presence/absence of the fixing bias are performed at different print speeds (20, 30 and 40 PPM) respectively in regard to the case where the above heating fixing apparatus according to the present embodiment is used, and to the case, cited as a comparative example, where the shape of the fixing film sliding part of the film guide 35 in the vicinity of the fixing nip part is set to substantially the radius of the fixing film on the upstream side of the fixing nip part in the recording material conveying direction, whereas the shape of the fixing film sliding part on the downstream side is set to convexity in the entire longitudinal edge of the film guide so as to project the entire fixing film toward the downstream direction. Thus, the results of the evaluations are shown in Table 3 below. In the table, it should be noted that symbol ○ indicates an OK level, symbol Δ indicates a level without problem on practical use, and symbol × indicates an NG level.

Besides, a pattern of which the leading end 100 mm represents characters and the trailing end represents solid white is printed on a plain paper which has been left for 24 hours or more under an environment of 23° C./60%RH, and then an offset state of a character pattern on the solid white part of the paper is observed and evaluated.

TABLE 3

| | | hot offset level | | |
|---|---|---|---|---|
| | fixing bias | 20 PPM | 30 PPM | 40 PPM |
| present embodiment | not present | ○ | ○ | Δ |
| | present | ○ | ○ | ○ |
| conventional example | not present | Δ | x | x |
| | present | ○ | Δ | x |

As the result of this, in the present embodiment, the comb-teeth projections 35*b* (FIG. 7, FIG. 8 and FIG. 3) are provided in the vicinity of the fixing nip part of the film guide on the downstream side of the fixing nip part in the recording material conveying direction, thereby partially projecting the fixing film 31 toward the downstream side. Thus, as compared with the comparative example, it is possible in the present embodiment to decrease the thermal transfer from the film guide 35 to the fixing film 31 at the separation point A as much as possible, and it is also possible as well as the embodiment 1 to confirm that the hot offset margin is wider and the heating fixing apparatus can achieve a higher-speed operation.

Next, in regard to the case where above heating fixing apparatus in the present embodiment is used and to the embodiment 1 (FIG. 2), a pattern on which lines are arranged in the direction perpendicular to the paper conveying direction is printed respectively on three kinds of papers, i.e., a thick paper, a plain paper and a thin paper (e.g., 105 g paper, 80 g paper and 60 g paper), which have been left for 24 hours or more under a high-temperature and high-humidity environment (e.g., 30° C./80%RH), and then a paper wrinkle state and a disarrangement of the image (transverse line pattern) are observed and evaluated. The results of the evaluations are shown in Table 4 below. In the table, it should be noted that symbol ○ indicates no problem, symbol Δ indicates that the image disarrangement occurs (but no paper wrinkle), and symbol × indicates that the paper wrinkle occurs. Here, it is assumed that the print speed is 30 PPM.

TABLE 4

| | paper wrinkle/image disarrangement level | | |
|---|---|---|---|
| | thick paper | plain paper | thin paper |
| present embodiment | ○ | ○ | ○ |
| embodiment 1 | ○ | Δ | x |

The rigidity of the thin paper is lower than that of the thick paper, and the firmness of the recording material is broken due to the leaving under the high-temperature and high-humidity environment. Therefore, as compared with the embodiment 1, it is possible in the present embodiment to confirm that the margin for the paper wrinkle is wider, and that the stability of the rotation locus of the fixing film 31 on the downstream side of the fixing nip part has an effect on the paper wrinkle.

That is, the rotation locus of the fixing film 31 on the downstream side of the fixing nip part is stabilized by changing the system of regulating only both the ends of the fixing film 31 by the flange members 36 as in the embodiment 1 to the system of regulating the entire longitudinal edge of the fixing film 31 by the film guide 35 so as to eliminate the slack or the like of the center part of the film as in the present embodiment. Thus, even if the thin recording material which has been left under the high-temperature and high-humidity environment that a paper wrinkle most easily occurs, it is possible to suppress the occurrence of the paper wrinkle.

<Others>

1) The heater 33 which acts as the heating member is not limited to the ceramic heater, that is, e.g., an electromagnetic induction heating member such as an iron plate or the like may be used.

2) The conformation of the pressure member may be a rotation belt or the like in addition to the pressure roller 32 as in the present embodiment.

3) The image heating apparatus according to the present invention is not only used as the heating fixing apparatus, but also used as the image heating apparatus which performs provisional fixing, the image heating apparatus which reheats the recording material on which the image has been borne to improve an image surface property such as glossiness or the like, and the like.

It should be noted that the present invention is not limited to the above embodiments, but includes various modifications of which the technical concept is the same as that of the present invention.

What is claimed is:

1. An image heating apparatus for heating an image formed on a recording material, comprising:

a heating member;

a flexible sleeve for rotating around said heating member;

a guide member, provided inside said sleeve, for guiding movement of said sleeve;

flange members, provided at both ends of said guide member in its longitudinal direction, each having a part sliding and rubbing with an interior periphery surface of an end of said sleeve; and a pressure member for forming a nip part to nip and convey the recording material in cooperation with said heating member through said sleeve, wherein, in a recording material movement direction, the sliding-rubbing part of said flange member on the downstream side of the nip part is longer than the sliding-rubbing part on an upstream side of the nip part toward the side of said pressure member.

2. An image heating apparatus according to claim 1, wherein said guide member and said sleeve on the downstream side of the nip part are not substantially in contact with each other.

3. An image heating apparatus according to claim 1, wherein said guide member has a plurality of ribs on both the upstream side and the downstream side of the nip part, and the number of ribs on the downstream side is smaller than the number of ribs on the upstream side.

4. An image heating apparatus for heating an image formed on a recording material, comprising:

a heating member;

a flexible sleeve for rotating around said heating member;

a guide member, provided inside said sleeve, for guiding movement of said sleeve;

a pressure member for forming a nip part to nip and convey the recording material in cooperation with said heating member through said sleeve, wherein, in a recording material movement direction, said guide member has a plurality of ribs on both an upstream side and a downstream side of the nip part, the number of ribs on the downstream side is smaller than the number of ribs on the upstream side, and the rib on the downstream side is larger than the rib on the upstream side.

5. An image heating apparatus for heating an image formed on a recording material, comprising:

a heating member;

a flexible sleeve for rotating around said heating member;

a guide member provided inside said flexible sleeve, for guiding a movement of said flexible sleeve;

flange members provided at ends of said guide member in its longitudinal direction, each of said flange members having a part sliding and rubbing with an interior periphery surface of an end of said flexible sleeve; and a pressure member for forming a nip part to nip and convey the recording material in cooperation with said heating member through said sleeve, wherein, in a recording material movement direction, an end portion of the sliding-rubbing part of said flange member on the downstream side of the nip part is nearer than an end portion of the sliding-rubbing part on an upstream side of the nip part to said pressure member.

6. An image heating apparatus according to claim 5, wherein said end portion of the sliding-rubbing part of said flange member on the downstream side of the nip part puts said sleeve off said guide member.

7. An image heating apparatus according to claim 5, wherein said guide member has a plurality of ribs on both the upstream side and the downstream side of the nip part, and the number of ribs on the downstream side is smaller than the number of ribs on the upstream side.

* * * * *